US005997096A

United States Patent [19]

Chen

[11] Patent Number: 5,997,096

[45] Date of Patent: Dec. 7, 1999

[54] CHAIR WITH A SEAT-SUPPORTING UNIT CAPABLE OF RESISTING LEFT AND RIGHT TILTING OF A SEAT SUPPORTED THEREON

[76] Inventor: Su-Ming Chen, No. 566, Fong-Lin 2nd Rd. Ta-Liao Hsiang, Kaohsiung Hsien, Taiwan

[21] Appl. No.: 09/262,737

[22] Filed: Mar. 5, 1999

[51] Int. Cl.[6] ..... A47C 7/02

[52] U.S. Cl. ..... 297/452.55; 297/452.1

[58] Field of Search ..... 297/452.55, 451.11, 297/451.13, 411.24, 411.27, 411.37, 452.57, 452.1

[56] References Cited

U.S. PATENT DOCUMENTS

| | | |
|---|---|---|
| 3,823,980 | 7/1974 | Harnick . |
| 3,851,920 | 12/1974 | Harris et al. . |
| 4,577,907 | 3/1986 | Talmon et al. . |
| 4,880,276 | 11/1989 | Shovar . |
| 5,522,645 | 6/1996 | Dahlbacka . |
| 5,681,093 | 10/1997 | Pfister . |

*Primary Examiner*—Milton Nelson, Jr.
*Attorney, Agent, or Firm*—Finnegan, Henderson, Farabow, Garrett & Dunner, L.L.P.

[57] ABSTRACT

A chair includes a base, a seat unit with aplastic casing, and a seat supporting unit, which is fixed on the base to support the seat unit thereon. The casing includes an upper plate and a lower plate, which are coupled together along outer peripheries thereof. The seat supporting unit includes a horizontal seat supporting plate, which is fixed thereon. An elongated metal auxiliary supporting member is fixed on the seat supporting plate, and has a left end portion that extends from a left side of the seat supporting plate, and a right end portion that extends from a right side of the seat supporting plate. Accordingly, the casing is supported on the seat supporting plate and the auxiliary supporting member. Preferably, the upper plate is formed integrally with a plurality of hollow posts, which are bolted to the seat supporting plate, thereby fixing the lower plate and the auxiliary supporting member between the upper plate and the seat supporting plate. As such, left and right tilting of the seat unit can be prevented by the auxiliary supporting member.

7 Claims, 6 Drawing Sheets

CHAIR WITH A SEAT-SUPPORTING UNIT CAPABLE OF RESISTING LEFT AND RIGHT TILTING OF A SEAT SUPPORTED THEREON

BACKGROUND OF THE INVENTION

1. Field of the Invention

This invention relates to a chair, more particularly to a chair, which has a seat supporting unit that can resist left and right tilting of a seat that is supported thereon.

2. Description of the Related Art

Referring to FIGS. 1 and 2, a conventional office chair is shown to include a plastic base plate 11, a soft seat 12, a seat supporting plate 13, two armrest members 14 (only one is visible in FIG. 1), a mobile base 15, and a wooden auxiliary supporting member 16. The seat 12 consists of a solid foam member 121 and a cloth member 122, which is attached to an upper surface of the foam member 121. A backrest member 131 is fixed on a rear portion of the seat supporting plate 13. Each of the armrest members 14 is formed integrally with a horizontal coupling plate 141, which is fixed to the seat supporting plate 13. A casing (not shown) has been proposed to substitute for the expensive solid foam member 121 and the wooden auxiliary supporting member 16, and consists of an upper plate and a lower plate, which are made of plastic and which engage each other along outer peripheries thereof. However, because the plates are made of plastic, which is flexible, they easily deform or even break. For example, when a person sits on the left or right side of the seat 12 or when a person sitting on the seat 12 pushes the armrest arms 14 during the act of standing, the seat 12 tilts to the left or right.

SUMMARY OF THE INVENTION

The object of this invention is to provide a chair with an inexpensive and durable seat supporting unit, which resists left and right tilting of a seat that is supported thereon.

According to this invention, a chair includes a base, a seat unit with a plastic casing, and a seat supporting unit, which is fixed on the base to support the seat unit thereon. The casing includes an upper plate and a lower plate, which are coupled together along outer peripheries thereof. The seat supporting unit includes a horizontal seat supporting plate, which is fixed thereon. An elongated metal auxiliary supporting member is fixed on the seat supporting plate, and has a left end portion that extends from a left side of the seat supporting plate, and a right end portion that extends from a right side of the seat supporting plate. Accordingly, the casing is supported on the seat supporting plate and the auxiliary supporting member. Preferably, the upper plate is formed integrally with a plurality of hollow posts, which are bolted to the seat supporting plate, thereby fixing the lower plate and the auxiliary supporting member between the upper plate and the seat supporting plate. As such, left and right tilting of the seat unit can be prevented by the auxiliary supporting member.

BRIEF DESCRIPTION OF THE DRAWINGS

The other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
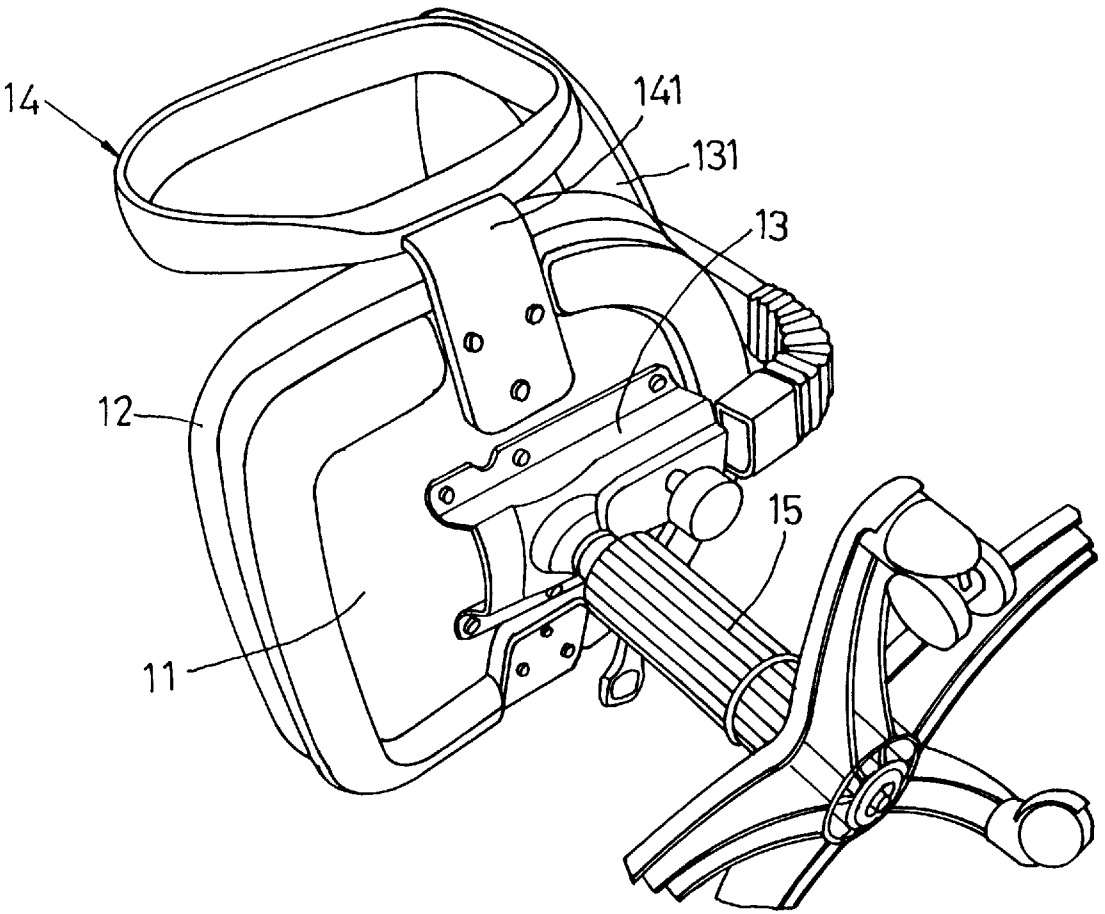
FIG. 1 PRIOR ART
FIG. 1 is a perspective view of a conventional chair.
Figure 2:
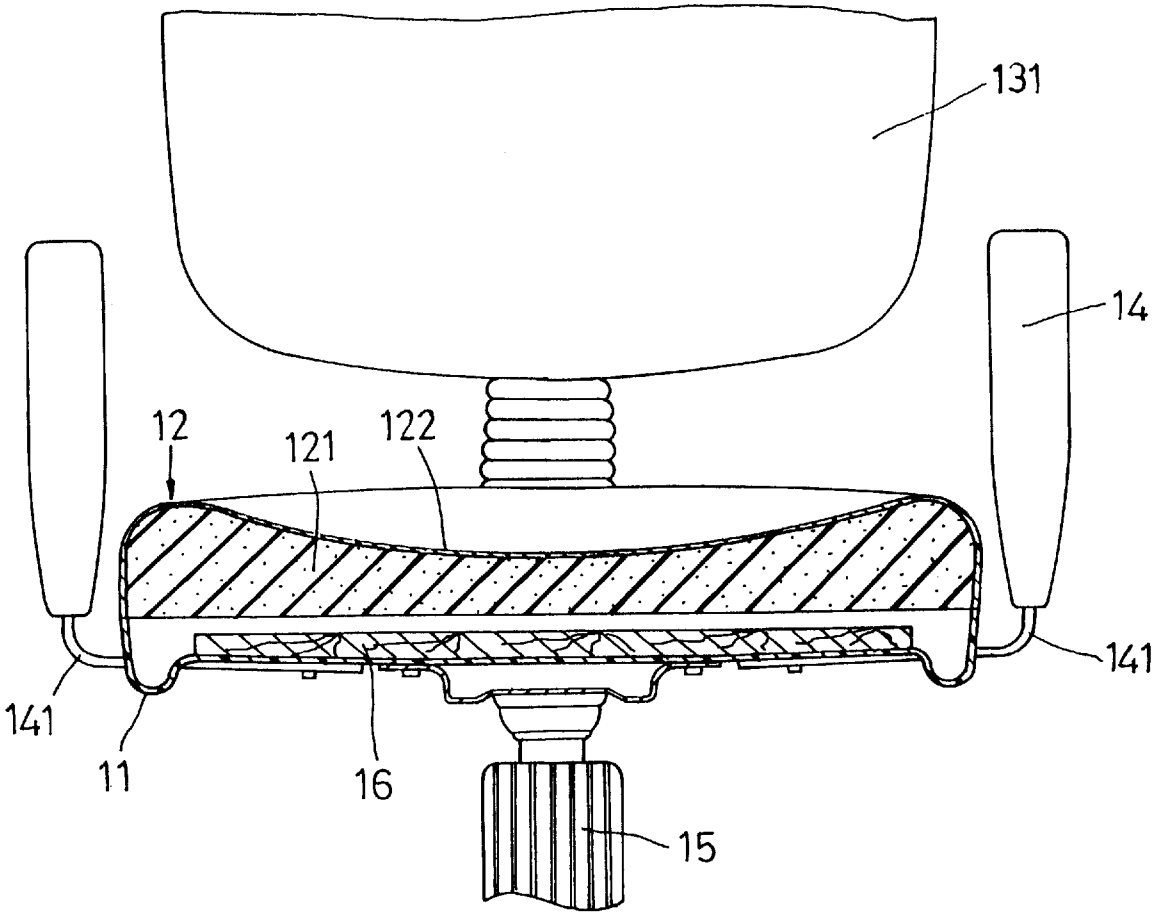
FIG. 2 PRIOR ART
FIG. 2 is a fragmentary partly sectional front schematic view illustrating the conventional chair.
Figure 3:
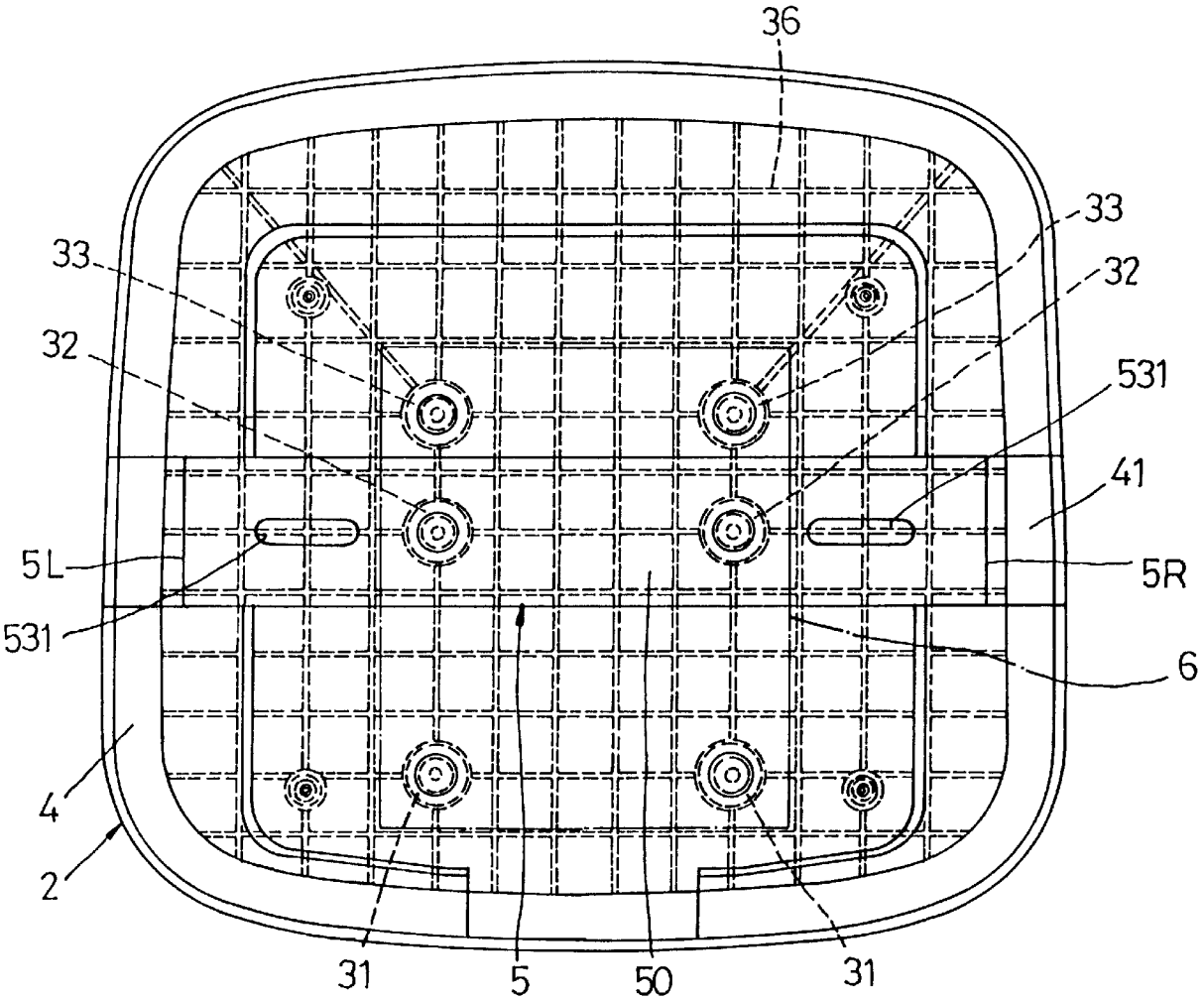
FIG. 3 is a schematic bottom view illustrating an assembly of a casing and an auxiliary supporting member of a first preferred embodiment of a chair according to this invention.
Figure 4:
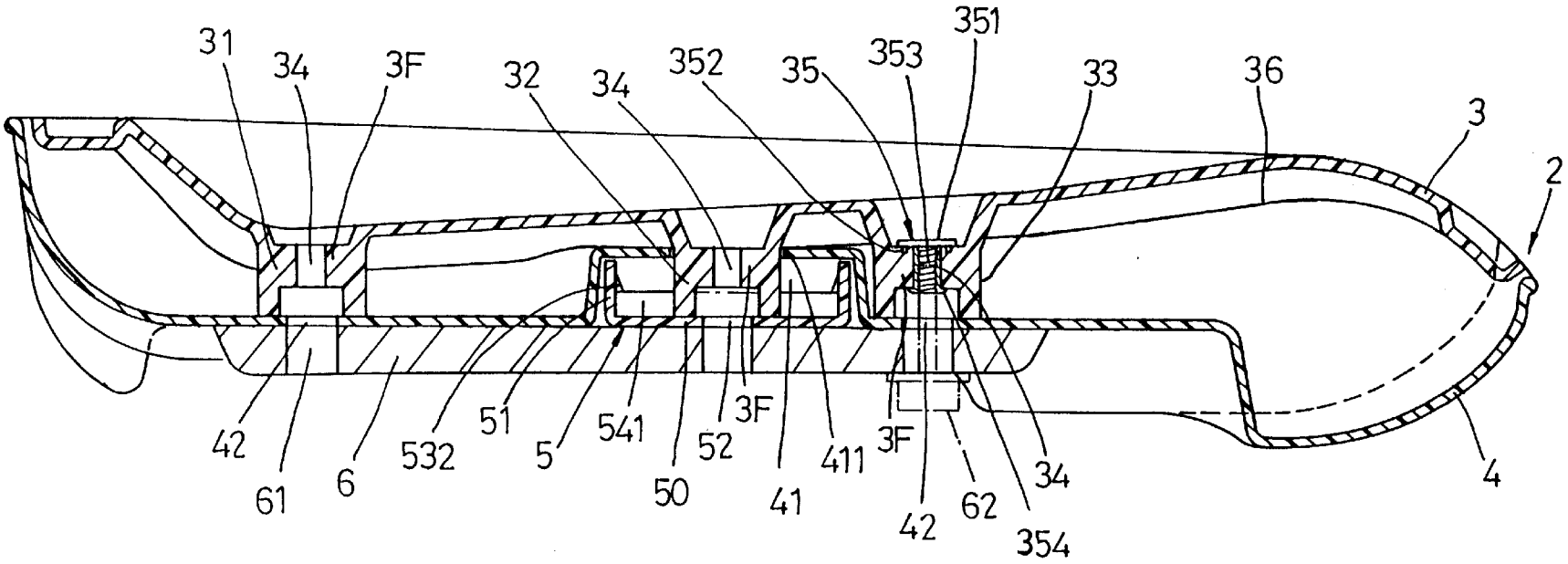
FIG. 4 is a sectional view of the assembly of the casing and the auxiliary supporting member of the first preferred embodiment.
Figure 5:
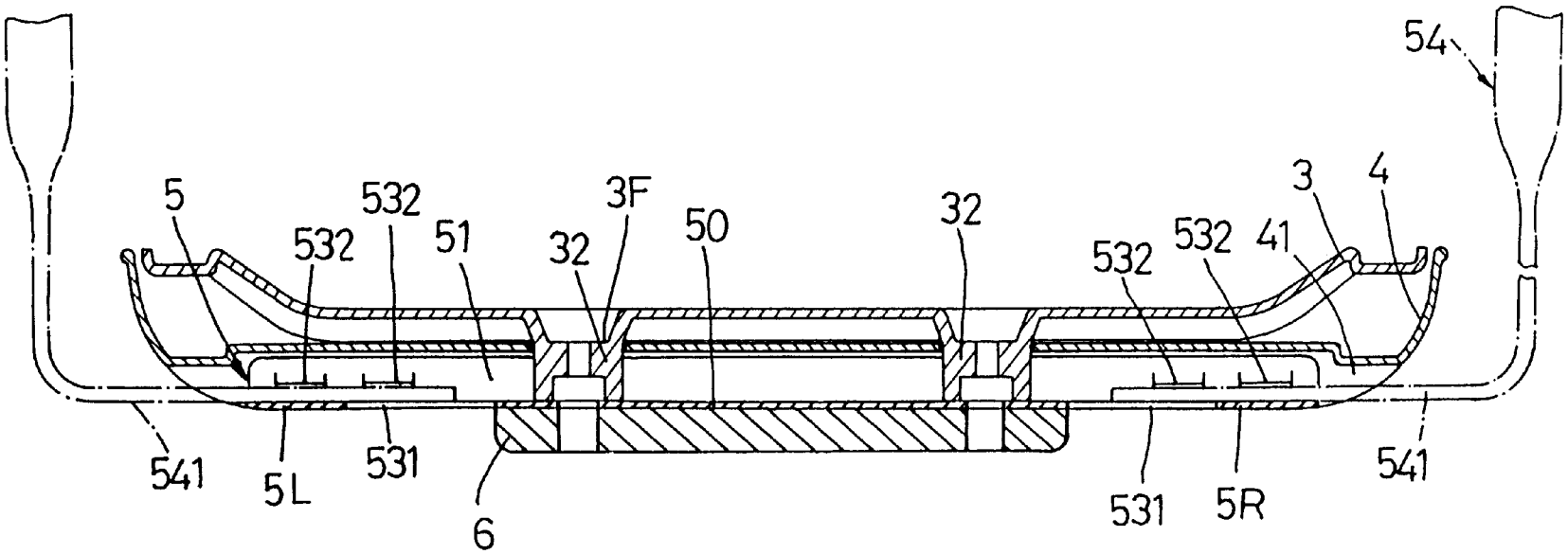
FIG. 5 is a schematic front sectional view illustrating the assembly of the casing and a seat supporting unit of the first preferred embodiment.

The chair of this invention has a base, which is similar to the prior art in construction so that only the portion of this invention other than the base, which includes a seat assembly, will be illustrated and described herein. FIGS. 3, 4 and 5 show the seat assembly of a first preferred embodiment of a chair of this invention. In this embodiment, the seat assembly includes a seat unit with a casing 2, which consists of an upper plate 3 and a lower plate 4, and a seat supporting unit, which consists of an elongated, metal auxiliary supporting member 5 and a horizontal, rigid seat supporting plate 6.

The seat supporting plate 6 is fixed to an upper end of the base (not shown) in a known manner.

The auxiliary supporting member 5 is fixed on the seat supporting plate 6, and has a left end portion (5L) (in the left side of FIGS. 3 and 5) that extends from a left side of the seat supporting plate 6, and a right end portion (5R) (in the right side of FIGS. 3 and 5) that extends from a right side of the seat supporting plate 6.

The upper and lower plates 3, 4 are made of plastic, and engage each other along outer peripheries thereof. The upper plate 3 has two rear hollow posts 31, two middle hollow posts 32, and two front hollow posts 33. The middle hollow posts 32 are longer than the rear hollow posts 31 and are shorter than the front hollow posts 33. The posts 31, 32, 33 extend integrally and downwardly from the upper plate 3, and are bolted to the seat supporting plate 6, thereby fixing the lower plate 4 and the auxiliary supporting member 5 between the upper plate 3 and the seat supporting plate 6. A middle portion of the casing 2 is supported on the auxiliary supporting member 5. A sponge material (not shown) is attached to the casing 2 in a known manner, thereby permitting sitting of a person thereon.

The auxiliary supporting member 5 has a U-shaped cross-section, a horizontal bottom wall 50 that rests on the seat supporting plate 6, and two parallel vertical side walls 51 that extend respectively, integrally, and upwardly from two opposite sides of the bottom wall 50. The bottom wall 50 has two aligned longitudinal slots 532, which are formed respectively through two end portions thereof. Each of the side walls 51 has a horizontal row of positioning projections 532, which protrude integrally and inwardly therefrom.

Two armrest members 54 (see FIG. 5) are disposed on two opposite sides of the seat supporting units. Each of the armrest members 54 is formed integrally with a horizontal insert plate 541 at a lower end thereof. The insert plates 541 are inserted respectively into two end portions of the auxiliary supporting member 5. The bottom surfaces of the insert plates 541 are placed on the bottom wall 51 of the auxiliary supporting member 5. The top surfaces of the insert plates 541 contact the positioning projections 532 of the auxiliary supporting member 5. Accordingly, the insert plates 541 are positioned on the auxiliary supporting member 5. Two bolts (not shown) extend respectively through the slots 531 in the auxiliary supporting member 5 and holes (not shown) in the insert plates 541 to fix the insert plates 541 on the auxiliary supporting member 5.

A middle portion of the lower plate 4 is bent to form an open-ended slot 41 in a bottom surface of a middle portion of the casing 2, and has two post holes 411, which are formed therethrough and which are communicated with the open-ended slot 41. The auxiliary supporting member 5 is disposed within the slot 41. The middle hollow posts 32 of the upper plate 3 extend respectively through the post holes 411 in the lower plate 4 to contact the bottom wall 51 of the auxiliary supporting member 5.

Each of the posts 31, 32, 33 is formed with an inward flange (3F), which extends radially and inwardly from a middle portion thereof to define a rivet hole 34 therein. Six hollow rivet members 35 (only one is shown in FIG. 4) extend respectively through the rivet holes 34. Each of the rivet members 35 has a horizontal top disk 351, a plurality of needles 352, a threaded hole 353, and a pressed outward flange 354. Each of the top disks 351 rests on a top surface of the corresponding inward flange (3F). Each of the needles 352 extends integrally and downwardly from a peripheral portion of the corresponding top disk 351, and is inserted into the corresponding inward flange (3F) to prevent rotation of the rivet members 35 in the rivet holes 34. Each of the threaded holes 353 is formed in a lower end surface of the corresponding rivet member 35. Each of the outward flanges 354 extends radially and outwardly from a lower end of the corresponding rivet member 35, and contacts a bottom surface of the corresponding inward flange (3F). Four bolt members 62 (only one is shown in phantom lines in FIG. 4) extend respectively through four bolt holes 61 in the seat supporting plate 6 and four bolt holes 42 in the lower plate 4 to engage the threaded holes 353 in the rivet members 35, which are disposed within the front and rear hollow posts 31, 33. Another two bolt members (not shown) extend respectively through two bolt holes 61 in the seat supporting plate 6 and two bolt holes 52 in the auxiliary supporting member 5 to engage the threaded holes 353 in the rivet members 35, which are disposed within the middle hollow posts 32. As such, the upper plate 3, the lower plate 4, the auxiliary supporting member 5, and the seat supporting plate 6 are coupled together.

The upper plate 3 has a bottom surface, which is formed with a grid-shaped reinforcing rib unit 36.

Because the auxiliary supporting member 5 is fixed on the seat supporting plate 6, left and right tilting of the seat unit can be prevented.

Figure 6:
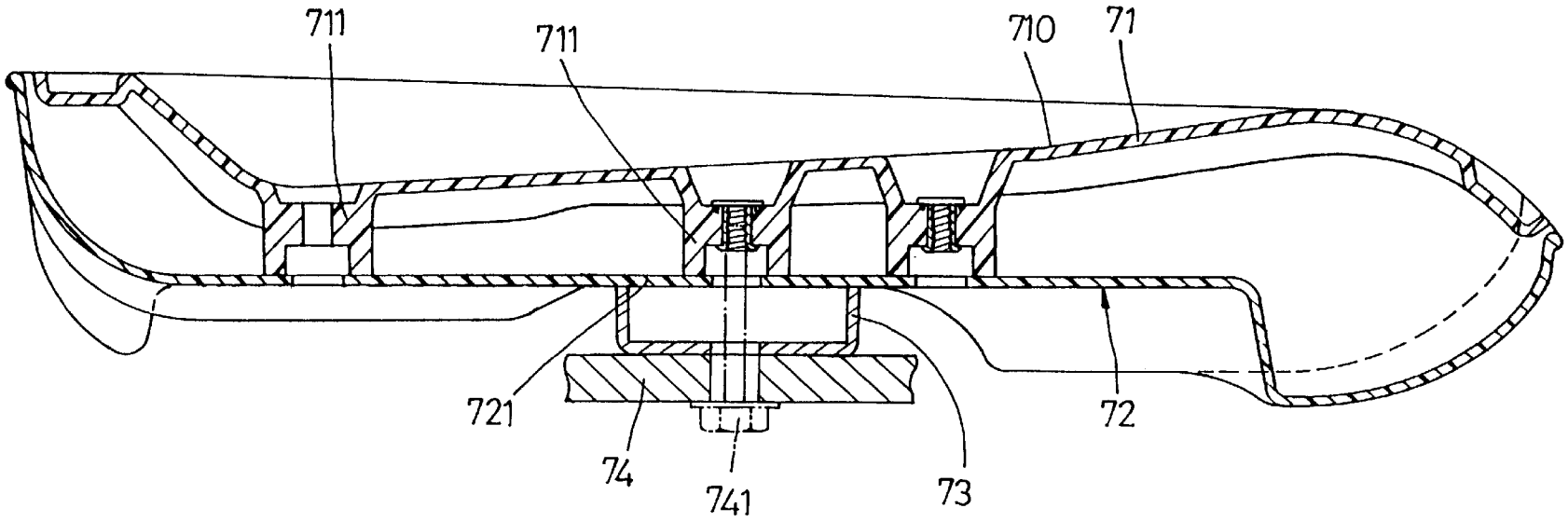
FIG. 6 is a schematic side sectional view illustrating an assembly of a casing and a seat supporting unit of a second preferred embodiment of a chair according to this invention.

FIG. 6 shows the seat assembly of a second preferred embodiment of this invention, which includes an upper plate 71, a lower plate 72, an auxiliary supporting member 73, and a seat supporting plate 74. The upper plate 71 and the auxiliary supporting member 73 are similar to the previous embodiment in construction. The lower plate 72 has a horizontal plate section 721. The upper plate 71 has a rearwardly and downwardly inclined plate section 710, which is formed with front, middle and rear hollow posts 711. The lower ends of the posts 711 are located at the same level, and abut against the horizontal plate section 721 of the lower plate 72. The auxiliary supporting member 73 is clamped between the horizontal plate section 721 of the lower plate 72 and the seat supporting plate 74. Six bolt members 741 (only one is shown) extend through the seat supporting plate 74 and the lower plate 72 to engage threadably the posts 711 of the upper plate 71.

With this invention thus explained, it is apparent that numerous modifications and variations can be made without departing from the spirit and scope of this invention. It is therefore intended that this invention be limited only as indicated by the appended claims.

I claim:

1. A chair comprising:

a base;

a seat supporting unit including a horizontal, rigid, seat supporting plate fixed to an upper end of said base, and an elongated auxiliary supporting member, which is made of metal and which is fixed on said seat supporting plate, said auxiliary supporting member having a left end portion that extends from a left side of said seat supporting plate, and a right end portion that extends from a right side of said seat supporting plate; and a seat unit with a casing, said casing including a lower plate, and an upper plate, which are made of plastic and which engage each other along outer peripheries thereof, said upper plate having a plurality of hollow posts that extend integrally and downwardly, said posts being bolted to said seat supporting plate, thereby fixing said lower plate and said auxiliary supporting member between said upper plate and said seat supporting plate, said casing having a middle portion, which is supported on said auxiliary supporting member.

2. A chair as claimed in claim 1, wherein at least one of said posts of said upper plate is formed with an inward flange, which extends radially and inwardly from a middle portion thereof to define a rivet hole therein, said chair further including a bolt member, and a hollow rivet member, which extends through said rivet hole and which has a horizontal top disk that rests on a top surface of said inward flange, a plurality of needles that extend integrally and downwardly from a peripheral portion of said top disk and that are inserted into said inward flange, a threaded hole formed in a lower end surface of said rivet member, and a pressed outward flange, which extends radially and outwardly from said rivet member and which contacts a bottom surface of said inward flange, each of said lower plate and said seat supporting plate having a bolt hole formed therethrough, said bolt member extending through said bolt holes in said lower plate and said seat supporting plate to engage said threaded hole in said rivet member, thereby coupling said upper plate, said lower plate, and said seat supporting plate together.

3. A chair as claimed in claim 1, wherein said upper plate has a bottom surface, which is formed with a grid-shaped reinforcing rib unit.

4. A chair as claimed in claim 1, wherein said auxiliary supporting member has a U-shaped cross-section, a horizontal bottom wall that rests on said seat supporting plate, and two parallel vertical side walls that extend respectively, integrally, and upwardly from two opposite sides of said bottom wall.

5. A chair as claimed in claim 4, wherein each of said side walls of said auxiliary supporting member has a horizontal row of positioning projections, which protrude integrally and inwardly therefrom, said chair further including two armrest members, which are disposed on two opposite sides of said seat supporting unit, each of said armrest members being formed integrally with a horizontal insert plate at a lower end thereof, said insert plates being inserted respectively into two end portions of said auxiliary supporting member and having bottom surfaces that are placed on said bottom wall of said auxiliary supporting member, and top surfaces that contact said positioning projections of said auxiliary member, whereby, said armrest members are positioned on said auxiliary supporting member.

6. A chair as claimed in claim 4, wherein said middle portion of said casing has a bottom surface, said lower plate having a post hole formed therethrough, and being bent to form an open-ended slot in said bottom surface of said middle portion of said casing, said auxiliary supporting member being disposed within said slot in said bottom surface of said casing, one of said posts of said upper plate extending through said post hole in said lower plate to contact said bottom wall of said auxiliary supporting member.

7. A chair as claimed in claim 1, wherein said lower plate has a horizontal plate section, said upper plate having a rearwardly and downwardly inclined plate section, said posts having lower ends, which are located at the same level and which abut against said horizontal plate section of said lower plate.

* * * * *